US007406284B2

(12) United States Patent
Begeal et al.

(10) Patent No.: US 7,406,284 B2
(45) Date of Patent: Jul. 29, 2008

(54) APPARATUS FOR IMPROVING IMAGE FIDELITY ON HIGH-SPEED ELECTROPHOTOGRAPHIC PRINTING SYSTEMS

(75) Inventors: Carlton E. Begeal, Longmont, CO (US); Richard A. Bell, Jr., Thornton, CO (US)

(73) Assignee: InfoPrint Solutions Company, LLC, Boulder, CO (US)

( * ) Notice: Subject to any disclaimer, the term of this patent is extended or adjusted under 35 U.S.C. 154(b) by 104 days.

(21) Appl. No.: 11/429,120

(22) Filed: May 5, 2006

(65) Prior Publication Data

US 2007/0258738 A1 Nov. 8, 2007

(51) Int. Cl.
*G03G 15/16* (2006.01)

(52) U.S. Cl. ..... 399/316; 399/318; 399/384

(58) Field of Classification Search ..... 399/316, 399/317, 318, 384, 388
See application file for complete search history.

(56) References Cited

U.S. PATENT DOCUMENTS 5,091,751 A * 2/1992 Inoue et al. ..... 399/318 X
5,179,417 A 1/1993 Sugaya et al.
5,400,125 A * 3/1995 Stuerzer et al. ..... 399/318 X
5,594,539 A * 1/1997 Murano et al. ..... 399/316
5,842,087 A * 11/1998 Matsushita et al. ..... 399/174
6,550,657 B1 * 4/2003 Taguchi ..... 399/388 X
7,155,153 B2 * 12/2006 Taguchi ..... 399/316

* cited by examiner

*Primary Examiner*—Sophia S Chen
(74) *Attorney, Agent, or Firm*—Dillon & Yudell LLP

(57) ABSTRACT

An electrophotographic printing system having an apparatus for improving image fidelity is disclosed. The electrophotographic printing system includes a photosensitive drum, a first and second retractors and a paper presser. The first and second retractors position a sheet of printing paper within a first and second predetermined distances, respectively, from the photosensitive drum. The paper presser, which is operatively secured to the second retractor, presses the printing paper firmly against the photosensitive drum when developed toner images on said photosensitive drum are being transferred onto the printing paper.

3 Claims, 1 Drawing Sheet

APPARATUS FOR IMPROVING IMAGE FIDELITY ON HIGH-SPEED ELECTROPHOTOGRAPHIC PRINTING SYSTEMS

BACKGROUND OF THE INVENTION

1. Technical Field

The present invention relates to electrophotographic printing systems in general, and, in particular, to an apparatus for improving image fidelity on a high-speed electrophotographic printing system.

2. Description of Related Art

Within a conventional electrophotographic continuous form printing system, a photosensitive drum is electrically charged by a charger while receiving a laser light beam, and each character written on the photosensitive drum in the form of a latent image is developed by a developer. As a strip of printing paper is being delivered through the printing system, the developed toner images on the photosensitive drum are transferred onto the printing paper. After the fixing operation has been completed, the printing paper is received in a stacker.

Sometimes, the print quality may be degraded during printing. Specifically, when the developed toner images are fixed onto the printing paper with the aid of a preheating plate and a heat roll in the electrophotographic printing unit, the printing paper is thermally damaged to a certain extent, causing it to be warped due to local expansion and contraction of the printing paper. In addition, when the developed toner images are transferred onto the printing paper from a photosensitive drum, a portion of the developed toner images will probably be incorrectly transferred onto the printing paper because of the above-mentioned warpage of the printing paper. As a result, a portion of the developed toner images representing certain characters is not printed on the printing paper.

Consequently, it would be desirable to provide an apparatus for improving image fidelity on a high-speed electrophotographic continuous form printing system.

SUMMARY OF THE INVENTION

In accordance with a preferred embodiment of the present invention, an electrophotographic printing system includes a photosensitive drum, a first and second retractors and a paper presser. The first and second retractors position a sheet of printing paper within a first and second predetermined distances, respectively, from the photosensitive drum. The paper presser, which is operatively secured to the second retractor, presses the printing paper firmly against the photosensitive drum when developed toner images on said photosensitive drum are being transferred onto the printing paper.

All features and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

Figure 1:
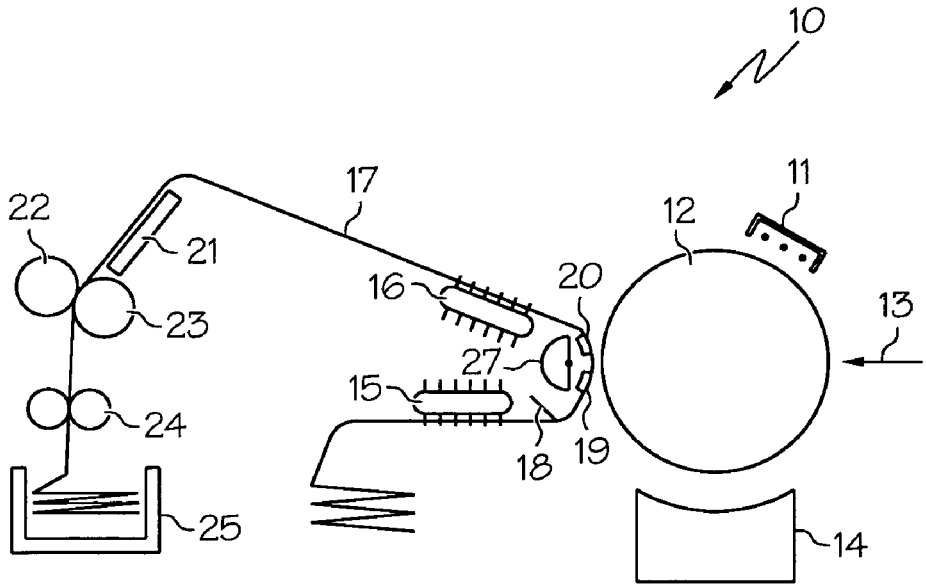
FIG. 1 is a schematic view of an electrophotographic printing system, in accordance with a preferred embodiment of the present invention.

Referring now to the drawings and in particular to FIG. 1, there is depicted a schematic view of an electrophotographic printing system, in accordance with a preferred embodiment of the present invention. As shown, an electrophotographic printing system 10 includes a charger 11, a photosensitive drum 12, a laser light beam 13, a developer 14, a first tractor 15, and a second tractor 16. During operation, a sheet of printing paper 17 is initially discharged by a first tractor 15. Subsequently, printing paper 17 is conveyed to a second tractor 16 via a retractor spring 18, a lower retractor 19 and an upper retractor 20. Developed toner images on photosensitive drum 12 are then transferred onto printing paper 17 by an image transfer unit 27.

Electrophotographic printing system 10 also includes a preheating plate 21 for fixing developed toner images, a heat roll 22, a back-up roll 23, a pair of puller rollers 24, and a stacker 25. As printing paper 17 is conveyed further by second tractor 16, printing paper 17 passes between heat roll 22 and back-up roll 23, causing the toner images on printing paper 17 to be fixed onto printing paper 17. After the completion of the fixing operation, printing paper 17 is received in stacker 25.

In order to accomplish the printing in electrophotographic printing system 10, a toner having a relatively low melting temperature is used such that electrically charged toner images are developed on photosensitive drum 12 and, after transference of the developed toner images onto one surface of printing paper 17, the images are fixed onto printing paper 17 under the pressure from heat roller 22 and backup roller 23. Rollers 22 and 23 are made of aluminum tubes coated with a film of tetrafluoroethylenebased synthetic resin and a halogen lamp (not shown) incorporated within the aluminum tubes. In addition, back-up roller 23 is constructed of a heat resistant silicone rubber of which surface is coated with a film of tetrafluoroethylene-based silicone synthetic resin having excellent releasability.

Figure 2:
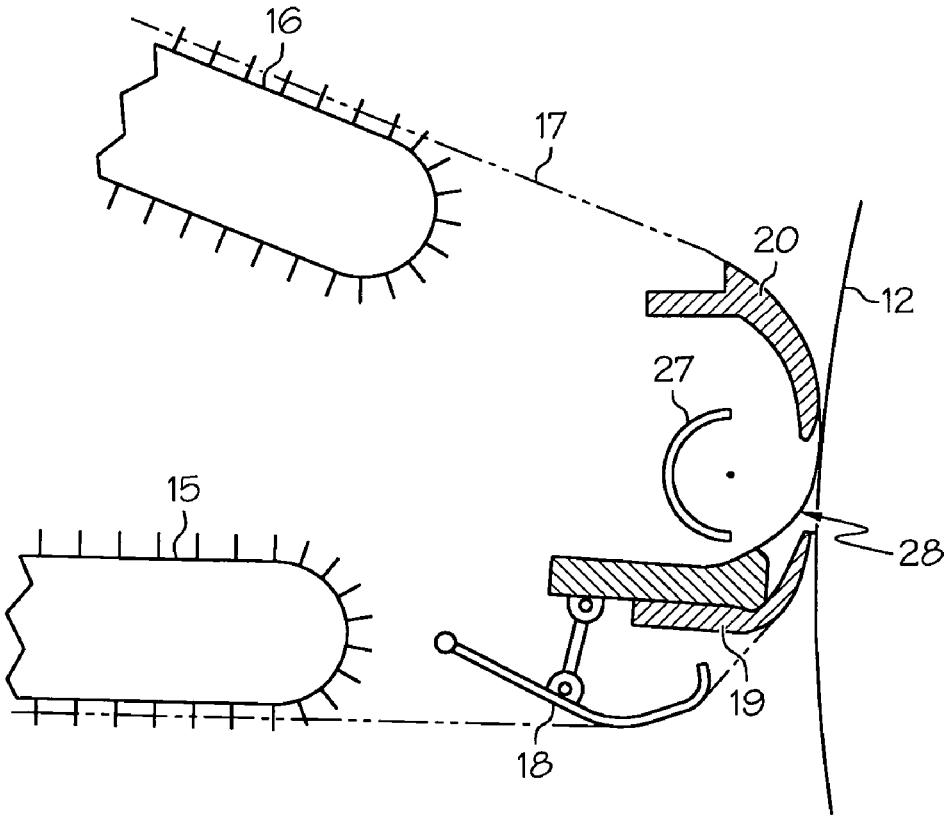
FIG. 2 is a schematic view of an apparatus for improving image fidelity of the electrophotographic printing system from FIG. 1, in accordance with a preferred embodiment of the present invention.

With reference now to FIG. 2, there is illustrated a schematic view of an apparatus for improving image fidelity of electrophotographic printing system 10, in accordance with a preferred embodiment of the present invention. As shown, a paper presser 28 is used to press printing paper 17 against photosensitive drum 12 when developed toner images are transferred onto the surface of printing paper 17. Paper presser 28 is operatively secured to the top portion of lower retractor 19 that conventionally serves to hold printing paper 17 in a space relationship relative to photosensitive drum 12 with a predetermined distance.

Preferably, paper presser 28 is made of a plate-shaped material having high elasticity and excellent wear resistance. For example, paper presser 28 can be a Milar®, polyethylene terephthalate (PET), strip having a thickness of approximately 0.2-0.3 mm. With paper presser 28 in place, developed toner images can be thermally fixed onto printing paper 17 only with the aid of heat roller 22 along with back-up roller 23.

As has been described, the present invention provides an apparatus for improving image fidelity on a high-speed electrophotographic continuous form printing system.

While the invention has been particularly shown and described with reference to a preferred embodiment, it will be understood by those skilled in the art that various changes in form and detail may be made therein without departing from the spirit and scope of the invention.

What is claimed is:

1. An electrophotographic printing system comprising:

a photosensitive drum;

a first retractor for positioning a sheet of printing paper within a first predetermined distance from said photosensitive drum;

a second retractor for positioning said printing paper within a second predetermined distance from said photosensitive drum; and a paper presser for pressing said printing paper firmly against said photosensitive drum when developed toner images on said photosensitive drum are being transferred onto said printing paper, wherein said paper presser is operatively secured to a top portion of said second retractor, wherein said paper presser is a strip made of polyethylene terephthalate (PET).

2. The apparatus of claim 1, wherein said paper presser is made of a plate-shaped material having high elasticity and excellent wear resistance.

3. The apparatus of claim 1, wherein said paper presser has a thickness of approximately 0.2-0.3 mm.

* * * * *